US005262272A

United States Patent [19]

Eian et al.

[11] Patent Number: 5,262,272

[45] Date of Patent: Nov. 16, 1993

[54] DYE PERMEABLE POLYMER INTERLAYERS

[75] Inventors: Gilbert L. Eian, Mahtomedi; Alan M. Miller, Cottage Grove; Takuzo Ishida, Woodbury, all of Minn.

[73] Assignee: Minnesota Mining and Manufacturing Company, Saint Paul, Minn.

[21] Appl. No.: 958,079

[22] Filed: Oct. 8, 1992

[51] Int. Cl.[5] ..... G03C 5/54

[52] U.S. Cl. ..... 430/203; 430/213; 430/214; 430/215; 430/941

[58] Field of Search ..... 430/201, 203, 213, 214, 430/215, 941

[56] References Cited

U.S. PATENT DOCUMENTS

| | | | |
|---|---|---|---|
| 2,761,791 | 9/1956 | Russell | 117/34 |
| 3,330,663 | 7/1967 | Weyde et al. | 96/94 |
| 3,634,089 | 4/1969 | Hamb | 96/87 |
| 3,700,458 | 10/1972 | Lindholm | 96/114.1 |
| 3,785,830 | 1/1974 | Sullivan et al. | 96/114.1 |
| 4,021,240 | 5/1977 | Cerquone et al. | 96/29 D |
| 4,123,274 | 10/1978 | Knight et al. | 96/66 T |
| 4,220,709 | 9/1960 | deMauriac | 430/353 |
| 4,374,921 | 2/1983 | Frenchik | 430/338 |
| 4,452,883 | 6/1984 | Frenchik et al. | 430/502 |
| 4,460,681 | 7/1984 | Frenchik | 430/502 |
| 4,474,867 | 10/1984 | Naito et al. | 430/203 |
| 4,478,927 | 10/1984 | Naito et al. | 430/203 |
| 4,483,914 | 11/1984 | Naito et al. | 430/203 |
| 4,507,380 | 3/1985 | Naito et al. | 430/203 |
| 4,594,307 | 6/1986 | Ishida | 430/203 |
| 4,780,010 | 10/1988 | Behrens et al. | 400/208 |
| 4,883,747 | 11/1989 | Grieve et al. | 430/542 |
| 4,923,792 | 5/1990 | Grieve et al. | 430/559 |

FOREIGN PATENT DOCUMENTS

| | | |
|---|---|---|
| 1243536 | 10/1988 | Canada . |
| 59-165054 | 9/1984 | Japan . |
| 59-168439 | 9/1984 | Japan . |
| 837095 | 12/1957 | United Kingdom . |

OTHER PUBLICATIONS

M. Sekiya et al., *Chem. Pharm. Bull.*, 1972, 20(2), p. 343.

T. Sohda et al., *Chem. Pharm. Bull.*, , 31(2), pp. 560–565.

W. S. Port et al., *Industrial and Engineering Chemistry*, 1955, 47, pp. 472–280.

Hamer, F. M., *The Cyanine Dyes and Related Compounds;* Interscience Publishers: New York, 1964; p. 492.

F. X. Smith et al., *Tetrahedron Lett.*, 1983, 24(45), pp. 4951–4954.

X. Huang., L. Xe, *Synth. Commun.*, 1986, 16(13), pp. 1701–1707.

H. Zimmer et al., *J. Org. Chem.*, 1960, 25, pp. 1234–1235.

*Research Disclosure*, No. 17029, Jun. 1978.

James T. H., *The Theory of the Photographic Process*, Fourth Ed.; MacMillan: New York, 1977; pp. 149–169.

*The Colour Index;* The Society of Dyes and Colourists: Yorkshire, England, 1971; vol. 4, p. 4437.

Venkataraman, K., *The Chemistry of Synthetic Dyes;* Academic Press: New York, 1952; vol. 2, p. 1206.

*Primary Examiner*—Richard L. Schilling

*Attorney, Agent, or Firm*—Gary L. Griswold; Walter N. Kirn; Gregory A. Evearitt

[57] ABSTRACT

Vinyl stearate-vinyl chloride copolymers and blends of polyvinyl stearate and polyvinyl chloride have been found to have good dye permeability. They have been incorporated into photothermographic constructions as barrier interlayers and dye receiving layers.

27 Claims, No Drawings

DYE PERMEABLE POLYMER INTERLAYERS

FIELD OF THE INVENTION

This invention relates to the use of vinyl stearate-vinyl chloride copolymers or blends of polyvinyl stearate and polyvinyl chloride as interlayers in imageable articles.

BACKGROUND OF THE ART

High quality three color photothermographic silver halide (i.e., dry silver) imaging constructions based on diffusion transfer of imaging dyes from imaging layers to a strippable image-receiving layer are known in the art. Those multilayer constructions require barrier interlayers between the imaging layers to prevent penetration of upper layers into the lower layers during solvent coating and drying operations, and to prevent crosstalk during development of the latent image following exposure. However, the barrier interlayers must also allow transfer of imaging dyes (formed during development) by diffusion to the image-receiving layer.

It is also desirable that the polymer coated as the image-receiving layer have high permeability to imaging dyes. In full color dry silver constructions, the various imaging dyes often have widely different chemical structures and, therefore, quite different tendencies to migrate in polymer films.

Dry silver compositions or emulsions are photothermographic compositions, and contain a light-insensitive, reducible silver source; a light-sensitive silver source; and a reducing agent for the light-insensitive, reducible silver source. The light-sensitive material is generally photographic silver halide, which must be in catalytic proximity to the light-insensitive, reducible silver source. Catalytic proximity requires an intimate physical association of these two materials so that when silver specks or nuclei are generated by the irradiation or light exposure of the photographic silver halide, those nuclei are able to catalyze the reduction of the light-insensitive, reducible silver source by the reducing agent. It has been long understood that silver halide is a catalyst for the reduction of silver ions and the silver-generating light-sensitive silver halide catalyst progenitor may be placed into catalytic proximity with the silver source in a number of different fashions, such as by partial metathesis of the light-insensitive, reducible silver source with a halogen-containing source, coprecipitation of silver halide and light-insensitive, reducible silver source material, and other methods that intimately associate the silver halide and the silver source.

In both photographic and photothermographic emulsions, exposure of the photographic silver halide to light produces small clusters of silver atoms. The image-wise distribution of these clusters is known in the art as a latent image, as this latent image generally is not visible by ordinary means, and the light-sensitive article must be further processed to produce a visual image. The visual image is produced by the catalytic reduction of silver ions, which are in catalytic proximity to the silver halide grains bearing the latent image.

Typically, in color dry silver imaging systems a leuco dye is incorporated as a reducing agent for the light-insensitive, reducible silver source, generally in combination with a spectral sensitizer for the silver halide. The leuco dye is oxidized to form a dye upon development, thereby giving a colored image. In full color constructions, spectrally-sensitized emulsion layers are typically coated onto a substrate and separated by one or more barrier interlayers.

Residual silver stain is a major problem with dry silver color constructions known in the art. This has been overcome by causing the developed dye image to diffuse from the dry silver layer to an image-receiving layer that is then stripped from the emulsion layer(s). In this case, a barrier interlayer must serve the dual roles of separating the chemistry of neighboring emulsion layers, and allowing diffusion of the dye image under thermal processing conditions.

Depending on the particular ingredients of a given dry silver layer, the development may be best carried out, for example, under acidic or basic conditions.

When multiple dry silver layers with incompatible developing chemistries are employed, it is very difficult to keep development conditions within the dry silver layer from affecting the development of nearby or adjacent dry silver layers. As a result, it is advantageous to coat dry silver layers with different developing conditions on opposite sides of a transparent substrate.

U.S. Pat. No. 4,594,307 discloses a heat developable photographic material that produces a pure and stable dye image by the oxidation-reduction reaction between a reducible organic silver salt and a leuco dye reducing agent wherein the dye image formed is transferred to an image-receiving layer by continuing the heating for development to separate the dye image formed from the silver images and other residual chemicals. However, this material is not capable of producing a multiple color or full color image on the same substrate.

The generation of color dry silver images has been accomplished using microencapsulated constructions and tri-pack (yellow/magenta/cyan) multilayer constructions, such as those disclosed in U.S. Pat. Nos. 4,883,747 and 4,923,792. The cited patents above employed S-97 Gantrez TM polystyrene, 523 Vinol TM partially hydrolyzed polyvinyl acetate, and B-76 Butvar TM polyvinyl butyral as barrier interlayers. These constructions generally have substantial silver and sensitizer stain present that affects the image color separation. The stain problem can be overcome by causing the developed dye image to diffuse from the image-forming layers into a receptor layer that is subsequently stripped from the rest of the construction. The success of this type of approach hinges in large part on the barrier interlayers between the image-forming layers of the tri-pack construction selectively permitting migration of the image-forming dyes while controlling the migration of other image-forming layer components, particularly leuco dyes.

U.S. Pat. No. 4,021,240 shows multiple layers in column 22, lines 7 to 65 and column 23, lines 1 to 57. Interlayers of polyvinyl alcohol are used to preserve the integrity of the color-forming layers. Other hydrophilic polymers, such as gelatin, were also found useful. The use of other synthetic polymeric binders alone or in combination as vehicles or binding agents in various layers is disclosed. Useful resins such as polyvinyl butyral, cellulose acetate butyrate, polymethyl methacrylate, ethyl cellulose, polystyrene, polyvinyl chloride, chlorinated rubber, butadiene-styrene copolymers, and vinyl chloride-vinyl acetate copolymers are also disclosed.

Multicolor photothermographic imaging articles are known in the art with the various color-forming layers separated from each other by functional or nonfunctional barrier layers between the various photosensitive layers. Photothermographic articles having at least two or three distinct color image-forming layers are disclosed in U.S. Pat. Nos. 4,021,240 and 4,460,681.

A process for forming an image in which mobile dyes are released by using the coupling reaction of a reducing agent oxidized by an oxidation-reduction reaction with silver halide or an organic silver salt at high temperature has been described in European Patent No. 79,056, West German Patent No. 3,217,853 and European Patent No. 67,455.

Copending U.S. application Ser. No. 07/775,193 discloses multicolor dry silver imaging constructions that require dye diffusion to an image-receiving layer. No mention is made in that application to the specific polymers employed herein, or to the particular advantages obtained by their use.

Copending U.S. application Ser. Nos. 07/895,045, 07/870,916, and 07/871,005 disclose various dye diffusive dry silver articles employing vinylidene chloride-containing copolymers as interlayer materials for selective dye diffusion.

SUMMARY OF THE INVENTION

What the background art does not teach, but this invention teaches is that copolymers of vinyl stearate-vinyl chloride or blends of polyvinyl stearate and polyvinyl chloride have high permeability to dyes of widely different chemical structure and dissimilar physical properties such as polarity, solubility, molecular size, and shape, etc., thereby providing a wide choice of image-forming dyes in multi-color (e.g., three color) imaging systems and better color balance in the final image. Accordingly, such vinyl stearate-vinyl chloride polymers or blends serve as excellent barrier interlayers or dye-receiving layer for dye diffusion photothermographic imaging systems.

Thus, in one embodiment, the present invention provides imageable articles having improved image stability comprising: (a) an image-forming layer comprising a source of imaging dye, and (b) an image-receiving layer, wherein a polymeric interlayer is interposed between the image-forming and image-receiving layers, and wherein the polymeric interlayer comprises a copolymer of vinyl chloride and vinyl stearate or a blend of polyvinyl chloride and polyvinyl stearate.

In another embodiment, the present invention provides dye diffusive dry silver photothermographic elements capable of providing improved color separation and print stability comprising a substrate coated on one side thereof with an image-receiving layer, the image-receiving layer having coated thereon at least one image-forming layer comprising a source of image dye separated from the image-receiving layer by a polymeric interlayer which comprises a copolymer of vinyl chloride and vinyl stearate or a blend of polyvinyl chloride and polyvinyl stearate.

In a further embodiment, the present invention provides dye diffusive dry silver photothermographic elements capable of providing improved color separation and print stability comprising a substrate coated on one side thereof with an image-receiving layer, the image-receiving layer having coated thereon or in intimate contact therewith at least one image-forming layer comprising a source of imaging dye wherein the image-receiving layer comprises a copolymer of vinyl chloride and vinyl stearate or a blend of polyvinyl chloride and polyvinyl stearate.

In all instances, the vinyl chloride-vinyl stearate copolymer or blend should have a $T_g$ of at least about 45° C. and preferably at least about 60° C.

The vinyl stearate-vinyl chloride copolymers and blends provide a good balance between solvent resistance and dye permeability when used in the present invention. Such a balance of properties is clearly important for the ability of a material to function as a barrier interlayer in the present invention and provides further differentiation of the barrier interlayer materials of the present invention over conventional barrier interlayer materials such as, for example, polyvinyl stearate which exhibits good permeability to various dyes but rather poor impermeability to coating solvents. Therefore, such a material has poor functional barrier interlayer properties.

Other aspects, advantages, and benefits of the present invention are apparent from the detailed description, the examples, and the claims.

DETAILED DESCRIPTION OF THE INVENTION

The present invention comprises an imageable article having improved image stability that comprises: (a) an image-forming layer comprising a source of imaging dye; and (b) an image-receiving layer, wherein a polymeric interlayer is interposed between the image-forming and image-receiving layer, and wherein the interlayer comprises a copolymer of vinyl chloride and vinyl stearate or a blend of polyvinyl chloride and polyvinyl stearate, the blend or copolymer having a $T_g$ of at least about 45° C.

While single color applications are envisioned, the greatest benefit of the present invention may be obtained in multicolor or full color applications. These typically comprise a substrate having a dye-receiving layer coated thereon, the dye-receiving layer having coated thereon a plurality of imaging layers separated by polymeric interlayers. At least one of the interlayers comprises either a copolymer of vinyl chloride and vinyl stearate or a blend of polyvinyl chloride and polyvinyl stearate.

Alternatively, the image-receiving layer may be supplied as an external component carried on a second substrate that is brought into contact (i.e., laminated) with a first substrate bearing an image-forming layer during processing such that the dye image is transferred from the first substrate to the image-receiving layer. In that case, the laminated construction constitutes an imaged construction according to the present invention.

Image-Forming Layer

The image-forming layer may be of any type known in the imaging art in which a colored dye image is formed by the steps of exposure and thermal development. Examples of such image-forming systems include, but are not limited to, nitrate ion-leuco dyes and diazonium-leuco dye systems.

In a preferred embodiment, the image-forming layer(s) comprises a dry silver composition comprising an intimate mixture of a light-sensitive silver halide; a light insensitive reducible silver source such as a silver salt of an organic acid (e.g., silver behenate, silver saccharine, or silver benzimidazolate) which upon reduction gives a visible change; and a reducing agent. Normally, dry silver compositions further comprise a spectral sensitizer. Such a mixture is usually prepared in a solvent as a dispersion that is spread as a layer on a suitable substrate. When dry, the layer is exposed to a light image and thereafter, a reproduction of the image is developed by heating the coated substrate.

Imaging layer(s) of the present invention may comprise a single coated layer or a plurality of sequentially coated sublayers in which the various components are dispersed. In cases where the imaging layers comprise a plurality of sublayers, the sublayer containing the silver halide is referred to as an emulsion layer.

Silver Halide

Silver halides known in the art for use in photothermography are useful in the present invention and include, but are not limited to, silver chloride, silver chlorobromide, silver chloroiodide, silver bromide, silver iodobromide, silver chloroiodobromide, and silver iodide.

The silver halide used in the present invention may be used as is. However, it may be chemically sensitized with a chemical sensitizing agent such as compounds of sulfur, selenium or tellurium, etc.; compounds of gold, platinum, palladium, rhodium or iridium, etc.; a reducing agent such as tin halide, etc.; or a combination of the foregoing thereof. Details thereof are described in James, T. H. *The Theory of the Photographic Process*, Fourth Ed.; MacMillan: New York, 1977; pp 149–169.

The light sensitive silver halide used in the present invention is typically employed in a range of about 0.01–15 percent by weight, and more preferably in the range of about 0.1 to 10 weight percent, based upon the total weight of each imaging layer in which the silver halide is present.

Sensitizer

The sensitizer employed in the dry silver composition may be any dye known in the photographic art that spectrally sensitizes silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes, and complex merocyanine dyes are particularly useful.

An appropriate amount of sensitizing dye added is generally in the range of from about $10^{-10}$ to $10^{-1}$ mole, and preferably from about $10^{-8}$ to $10^{-3}$ mole per mole of silver halide.

Light-Insensitive, Reducible Organic Silver Salt

The light-insensitive organic silver salt that can be used in the present invention is a silver salt that is comparatively stable to light and which forms a silver image by reacting with a leuco compound or an auxiliary developing agent that is coexisting with the leuco compound, if desired, when it is heated to a temperature of above 80° C., and preferably, above 100° C. in the presence of exposed silver halide. Suitable organic silver salts include silver salts of organic compounds having a carboxyl group. Preferred examples thereof include silver salts of aliphatic and aromatic carboxylic acids. Preferred examples of silver salts of aliphatic carboxylic acids include silver behenate, silver stearate, silver oleate, silver laurate, silver caproate, silver myristate, silver palmitate, silver maleate, silver fumarate, silver tartarate, silver linoleate, silver butyrate, silver camphorate, and mixtures thereof, etc. Silver salts that are substituted with a halogen atom or a hydroxyl group can also be effectively used. Preferred examples of silver salts of aromatic carboxylic acids and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenyl benzoate, silver gallate, silver tannate, silver phthalate, silver terephthalate, silver salicylate, silver phenylacetate, silver pyromellitate, silver salts of 3-carboxymethyl-4-methyl-4-thiazoline-2-thiones or the like as described in U.S. Pat. No. 3,785,830; and silver salts of aliphatic carboxylic acids containing a thioether group as described in U.S. Pat. No. 3,330,663. Silver salts of compounds containing mercapto or thione groups and derivatives thereof can be used. Preferred examples of these compounds include silver 3-mercapto-4-phenyl-1,2,4-triazolate, silver 2-mercaptobenzimidazolate, silver 2-mercapto-5-aminothiadiazolate, silver 2-(S-ethylglycolamido)benzothiazolate; silver salts of thioglycolic acids such as silver salts of S-alkyl thioglycolic acids (wherein the alkyl group has from 12 to 22 carbon atoms); silver salts of dithiocarboxylic acids such as silver dithioacetate, silver thioamidoate, silver 1-methyl-2-phenyl-4-thiopyridine-5-carboxylate, silver triazinethiolate, silver 2-sulfidobenzoxazole; and silver salts as described in U.S. Pat. No. 4,123,274. Furthermore, silver salts of a compound containing an amino group can be used. Preferred examples of these compounds include silver salts of benzotriazoles, such as silver benzotriazolate; silver salts of alkyl-substituted benzotriazoles such as silver methylbenzotriazolate, etc.; silver salts of halogen-substituted benzotriazoles such as silver 5-chlorobenzotriazolate, etc.; silver salts of carboimidobenzotriazoles, etc.; silver salts of 1,2,4-triazoles and 1-H-tetrazoles as described in U.S. Pat. No. 4,220,709; silver salts of imidazoles; and the like.

The silver halide and the organic silver salt that form a starting point of development should be in reactive association (i.e., in the same layer, in adjacent layers, or layers separated from each other by an intermediate layer having a thickness of less than 1 micron). It is preferred that the silver halide and the organic silver salt are present in the same layer.

The silver halide and the organic silver salt that are separately formed in a binder can be mixed before use to prepare a coating solution, but it is also effective to blend both of them in a ball mill for a long time. Further, it is effective to use a process which comprises adding a halogen-containing compound in the organic silver salt prepared to partially convert the silver of the organic silver salt to silver halide.

Methods of preparing silver halide and organic silver salts and manners of blending them are described in *Research Disclosures* No. 17029 and U.S. Pat. No. 3,700,458.

The light-insensitive, reducible source of silver is preferably present in an amount of from 0.1 to 50 weight percent, and more preferably from about 1–5 weight percent, based upon the total weight of each imaging layer(s) in which the silver source is present.

A suitable coating amount of the light-sensitive silver halide and the organic silver salt employed in the present invention is in a total from 50 mg to 10 g/m$^2$, calculated as an amount of silver as disclosed, for example, in U.S. Pat. No. 4,478,927.

Reducing Agent

Suitable reducing agents for use in the present invention are compounds that oxidize to directly or indirectly form a dye image. In practice of the present invention at least one imaging layer must comprise an image-forming material capable of forming a mobile dye by oxidization. This may be accomplished by substantially any means known in the photothermographic art including, but not limited to, the use of a leuco dye.

Preferred neutral leuco dyes are phenolic leuco dyes such as 2-(3,5-di-t-butyl-4-hydroxyphenyl)-4,5-3-diphenylimidazole, or bis(3,5-di-t-butyl-4-hydroxyphenyl)phenylmethane. Other phenolic leuco dyes useful in practice of the present invention are disclosed in U.S. Pat. Nos. 4,374,921; 4,460,681; 4,594,307; and 4,780,010, which are incorporated herein by reference.

Leuco dyes used in the present invention may be any colorless or lightly colored compound that forms a visible dye upon oxidation. The compound must be oxidizable to a colored state. Compounds that are both pH sensitive and oxidizable to a colored state are useful, but not preferred, while compounds only sensitive to changes in pH are not included within the term "leuco dyes" since they are not oxidizable to a colored form. The dyes formed from the leuco dye in the various color-forming layers should, of course, be different. A difference of at least 60 nm in reflective maximum absorbance is preferred. More preferably, the absorbance maximum of dyes formed will differ by at least 80–100 nm. When three dyes are to be formed, two should preferably differ by at least these minimums, and the third should preferably differ from at least one of the other dyes by at least 150, and more preferably, by at least 200. Any leuco dye capable of being oxidized by silver ion to form a visible dye is useful in the present invention as previously noted. Leuco dyes such as those disclosed in U.S. Pat. Nos. 3,442,224; 4,021,250; 4,022,617 and 4,368,247 are also useful in the present invention.

Other leuco dyes may be used in imaging layers as well, for example, benzylidene leuco compounds cited in U.S. Pat. No. 4,923,792, incorporated herein by reference. The reduced form of the dyes should absorb less strongly in the visible region of the electromagnetic spectrum and be oxidized by silver ions back to the original colored form of the dye. Benzylidene dyes have extremely sharp spectral characteristics giving high color purity of low gray level. The dyes have large extinction coefficients, typically on the order of $10^4$ to $10^5$ mole-cm liter$^{-1}$, and possess good compatibility and heat stability. The dyes are readily synthesized and the reduced leuco forms of the compounds are very stable.

The dyes generated by the leuco compounds employed in the elements of the present invention are known and are disclosed, for example, in *The Colour Index*; The Society of Dyes and Colourists: Yorkshire, England, 1971; Vol. 4, p. 4437; and Venkataraman, K. *The Chemistry of Synthetic Dyes*; Academic Press: New York, 1952; Vol. 2, p. 1206; U.S. Pat. No. 4,478,927, and Hamer, F. M. *The Cyanine Dyes and Related Compounds*; Interscience Publishers: New York, 1964; p. 492.

Leuco dye compounds may readily be synthesized by techniques known in the art. There are many known methods of synthesis from precursors since the reaction is a simple two-step hydrogen reduction. Suitable methods are disclosed, for example, in: F. X. Smith et al. *Tetrahedron Lett.* 1983, 24(45), 4951–4954; X. Huang., L. Xe, *Synth. Commun.* 1986, 16(13) 1701–1707; H. Zimmer et al. *J. Org. Chem.* 1960, 25, 1234–5; M. Sekiya et al. *Chem. Pharm. Bull.* 1972, 20(2), 343; and T. Sohda et al. *Chem. Pharm. Bull.* 1983, 31(2) 560–5.

Further, as other image forming materials, materials where the mobility of the compound having a dye part changes as a result of an oxidation-reduction reaction with silver halide, or an organic silver salt at high temperature can be used, as described in Japanese Patent Application No. 165054 (1984). Many of the above-described materials are materials wherein an image-wise distribution of mobile dyes corresponding to exposure is formed in the light-sensitive material by heat development. Processes of obtaining visible images by transferring the dyes of the image to a dye fixing material (diffusion transfer) have been described in the above described cited patents and Japanese Patent Application Nos. 168,439 (1984) and 182,447 (1984).

Still further the reducing agent may be a compound that releases a conventional photographic dye coupler or developer on oxidation as is known in the art. When the heat developable, light-sensitive material used in this invention is heat developed in a substantially water-free condition after or simultaneously with image-wise exposure, a mobile dye image is obtained simultaneously with the formation of a silver image either in exposed areas or in unexposed areas with exposed light-sensitive silver halide.

The total amount of reducing agent utilized in the present invention should preferably be in the range of 1–50 weight percent, and more preferably in the range of 5–20 weight percent, based upon the total weight of each individual layer in which the reducing agent is employed.

The light-sensitive silver halide and the organic silver salt oxidizing agent used in the present invention are generally added to at least one binder as described herein below. Further, the dye-releasing redox compound is dispersed in the binder described below.

The binder(s) that can be used in the present invention can be employed individually or in combination with one another. The binder may be hydrophilic or hydrophobic. A typical hydrophilic binder is a transparent or translucent hydrophilic colloid, examples of which include a natural substance, for example, a protein such as gelatin, a gelatin derivative, a cellulose derivative, etc.; a polysaccharide such as starch, gum arabic, pullulan, dextrin, etc.; and a synthetic polymer, for example, a water-soluble polyvinyl compound such as polyvinyl alcohol, polyvinyl pyrrolidone, acrylamide polymer, etc. Another example of a hydrophilic binder is a dispersed vinyl compound in latex form which is used for the purpose of increasing dimensional stability of a photographic material.

Preferably, the binder is present in an amount in the range of from 1–99 weight percent, and more preferably, from 20–80 weight percent in each imaging layer in which the binder is employed.

The coating amount of the binder used in the present invention is 20 g or less per m$^2$, preferably, 10 g or less per m$^2$, and more preferably, 7 g or less per m$^2$.

The preferred photothermographic silver containing polymer is polyvinyl butyral, but ethyl cellulose, methacrylate copolymers, maleic anhydride ester copolymers, polystyrene, and butadiene-styrene copolymers can be used where applicable according to the solvents used.

In the photographic light-sensitive material and the dye fixing material of the present invention, the photographic emulsion layer and other binder layers may contain inorganic or organic hardeners. It is possible to use chromium salts such as chromium alum, chromium acetate, etc.; aldehydes such as formaldehyde, glyoxal, glutaraldehyde, etc.; N-methylol compounds such as dimethylolurea, methylol dimethylhydantoin, etc.; dioxane derivatives such as 2,3-dihydroxydioxane, etc.; active vinyl compounds such as 1,3,5-triacryloylhexahydro-s-triazine, 1,3-vinylsulfonyl-2-propanol, etc.; active halogen compounds such as 2,4-dichloro-6-hydroxy-s-triazine, etc.; mucohalogenic acids such as mucochloric acid, and mucophenoxychloric acid, etc.; which may be used individually or as a combination thereof.

Dye-Receiving Layer

Dyes generated during thermal development of light-exposed regions of the emulsion layers migrate under development conditions into a dye-receiving layer wherein they are retained. The dye-receiving layer may be composed of a polymeric material having affinity for the dyes employed. Necessarily, it will vary depending on the ionic or neutral characteristics of the dyes.

Examples of organic polymeric materials used in the dye-receiving material of this invention include polystyrene having a molecular weight of 2,000 to 85,000, polystyrene derivatives having substituents with not more than 4 carbon atoms, poly(vinylcyclohexene), poly(-divinylbenzene), poly(N-vinylpyrrolidine), poly(vinylcarbazole), poly(allylbenzene), poly(vinyl alcohol), polyacetals such as polyvinyl formal and polyvinyl butyral, polyvinyl chloride, chlorinated polyethylene, polytrifluoroethylene, polyacrylonitrile, poly(N,N-dimethylallylamide), polyacrylates having a p-cyanophenyl group, a pentachlorophenyl group or a 2,4-dichlorophenyl group, poly(acryl chloroacrylate), poly(methyl methacrylate), poly(ethyl methacrylate), poly(propyl methacrylate), poly(isopropyl methacrylate), poly(isobutyl methacrylate), poly(tert-butyl methacrylate), poly(cyclohexyl methacrylate), polyethylene glycol dimethacrylate, poly(cyanoethyl methacrylate), polyesters such as polyethylene terephthalate, polysulfone Bisphenol A polycarbonate, polycarbonates, polyanhydrides, polyamides and cellulose acetate. The synthetic polymers described in "Polymer Handbook", 2nd Edition (edited by J. Brandrup and E. H. Immergut, published by John Wiley and Sons, Inc.) are also useful. These polymeric substances may be used singly, or a plurality of them may be used in the form of a copolymer.

Interlayers

Interlayers employed in the present invention are selected from polymeric materials that are permeable to dyes used to form the developed image. They are preferably coated from solvents in which the previously coated emulsion layer is not soluble. At least one of the interlayers employed in the present invention must be a copolymer of vinyl stearate and vinyl chloride or a blend of polyvinyl stearate and polyvinyl chloride. The copolymer may be either block or random. The weight of vinyl stearate to vinyl chloride in the copolymer or blend should be from about 3.5:1 to 19:1, preferably from about 4:1 to 19.1. The copolymer or blend should have a $T_g$ of at least about 45° C., and preferably at least about 60° C.

These polymers can be used as interlayers in construction of an at least two, and preferably at least three, color photothermographic color recording system. This type of construction with the proper-solvent selection is conducive to the use of simultaneous multiple coating techniques with good color separation, and enables the simultaneous thermal development of at least two or at least three individual color forming photothermographic systems having different chemistry, but similar thermal properties.

Preferably, the interlayers employed in the imageable articles of the present invention should be impermeable to the solvent employed in any layers subsequently coated onto it. The test for determining if an interlayer polymer is impermeable to the solvent of the next layer can be simply performed. First, coat a layer containing a sensitized, halidized silver salt of a fatty carboxylic (for example 10–32 carbon atoms, preferably 12–29 carbon atoms) acid and poly(vinyl butyral) polymer. A second coating of the candidate interlayer polymer is applied after the first coating has dried. The last layer contains the appropriate solvent, a color forming developer, and toner reactant. The dried coatings are given an excessive light exposure and then heated for 60 seconds at 255°–280° F. The test is positive if no color or image is formed.

The imageable elements of the present invention may optionally be overcoated with a protective coating. Suitable materials for the protective coating include, but are not limited to, polymers that are insoluble in aqueous systems, soluble in some organic solvents, and impervious to certain other organic solvents. The barrier layer may be crosslinked also. This would be preferably done by the inclusion of a latent or activatable crosslinking agent. Crosslinking could then be effected after coating.

The theory of this process is essentially the same for a light-sensitive material comprising a negative emulsion and a light-sensitive material comprising a direct positive emulsion and differs only in that the portion to be developed is an exposed area in one and an unexposed area in the other. Accordingly, even when a direct positive emulsion is used, a dye image providing good color reproducibility is obtained in the same way as in the case of a negative emulsion.

Heating in a substantially water-free condition, as used herein, means heating at a temperature of 80° to 250° C. The term "substantially water-free condition" means that the reaction system is in equilibrium with water in the air, and water for inducing or promoting the reaction is not particularly or positively supplied from exterior to the element. Such a condition is described at page 374 of "The Theory of the Photographic Process", 4th Edition (T. H. James, published by Macmillan Co.).

The coating solution used in this invention may be prepared by separately forming a silver halide and an organic silver salt oxidizing agent, and mixing them before use. It is also effective to mix the two in a ball mill for a long period of time. Another effective method comprises adding a halogen-containing compound to the prepared organic silver salt oxidizing agent, and forming silver halide by the reaction of the halogen-containing compound with silver in the organic silver salt oxidizing agent.

The various layers comprising the imageable articles of the present invention may contain surface active agents for various purposes, for example, as coating aids or for prevention of electrical charging, improvement of lubricating properties, emulsification, prevention of adhesion, improvement of photographic properties (for example, acceleration of development providing hard tones or sensitization), etc. For example, it is possible to use nonionic surface active agents such as saponin (steroid), alkylene oxide derivatives (for example, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkyl amines or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxyl group, a sulfo group, a phospho group, a sulfate group, a phosphate group, etc., such as alkylcarboxylic acid salts, alkylsulfonic acid salts, alkylbenzenesulfonic acid salts, alkylnaphthalenesulfonic acid salts, alkyl sulfuric acid esters, alkylphosphoric acid esters, N-acyl-N-alkyltaurines, sulfosuccinic acid esters, sulfoalkyl polyoxyethylene alkyl phenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkyl betaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol-type nonionic surface active agents having a repeating unit of ethylene oxide in their molecules are often preferably incorporated into the light-sensitive material. It is particularly preferred that the molecule contains 5 or more of the recurring units of ethylene oxide.

The light-sensitive material used in the present invention may contain, if desired or necessary, various additives known for heat developable light-sensitive materials and may have a layer or layers other than the light-sensitive layer, for example, an antistatic layer, an electrically conductive layer, a protective layer, an intermediate layer, an antihalation layer, a strippable layer, etc.

The imageable articles the present invention are coated on a substrate. Suitable substrates include rigid and flexible substrates; metals (for example, steel and aluminum plates, sheets, and foils); films or plates composed of various film-forming synthetic or high polymers including addition polymers (for example, polyvinylidene chloride, polyvinyl chloride, polyvinyl acetate, polystyrene, and polyisobutylene), and linear condensation polymers (for example, polyethylene terephthalate, polyhexamethylene adipate, and polyhexamethylene adipamide/adipate); nonwoven wood byproduct based substrates such as paper and cardboard; and glass. Substrates may be transparent or opaque.

Especially useful substrates are films of cellulose acetate films such as cellulose triacetate or diacetate, films of polyamides derived from a combination of heptamethylenediamine and terephthalic acid, a combination of fluorenedipropylamine and adipic acid, a combination of hexamethylenediamine and diphenic acid, and a combination of hexamethylenediamine and isophthalic acid, films of polyesters derived from a combination of diethylene glycol and diphenylcarboxylic acid and a combination of bis-p-carboxyphenoxybutane and ethylene glycol, a polyethylene terephthalate film, and a polycarbonate film.

The films may be modified; for example, polyethylene terephthalate films modified by such modifiers as cyclohexanedimethanol, isophthalic acid, methoxypolyethylene glycol, or 1,2-dicarbomethoxybenzenesulfonic acid are effective.

The substrate used for the light-sensitive material in the present invention is one that has good dimensional stability at the processing temperature. The polyesters described in U.S. Pat. No. 3,634,089 are preferably used. More preferably, a polyethylene terphthalate film is used.

If necessary, two or more layers may be applied at the same time by the method as described in U.S. Pat. No. 2,761,791 and British Patent No. 837,095.

In the present invention, the latent image obtained after exposure of the heat-sensitive material can be developed by heating the material at a moderately elevated temperature of, for example, about 80° to about 250° C., for about 0.5 second to about 300 seconds. By increasing or decreasing the heating time, the temperature may be higher or lower within the above range. Temperatures in the range of about 110° to about 160° C. are especially useful. Heating may be carried out by the typical heating means such as a hot plate, an iron, a hot roller, a heat generator using carbon or titanium white, or the like.

Heating for transfer of the dyes can be effected by using the same heating means as exemplified for the heat development. To increase the quality of the dye image transferred to the dye receiving layer, it is preferred to prevent an increase in fogging by the occurrence of unnecessary development during dye transfer. For this purpose, it is especially effective to include a compound that reacts with the silver halide and/or can have the silver halide adsorbed thereon as a development stopping agent and/or an antifoggant in any one of the layers constituting the dye receiving material. Such a compound is preferably included in the dye-receiving layer or a layer provided above the dye-receiving layer, such as a protective layer, because it rapidly inhibits excessive development of the light-sensitive layer during transfer of the dye by heating and a sharp and clear dye image can be obtained. Such compounds include, for example, a nitrogen-containing heterocyclic compound, preferably a 5- or 6-membered heterocyclic compound containing a nitrogen atom.

The following non-limiting examples further illustrate the present invention.

EXAMPLES

Materials used in the following examples were available from standard commercial sources such as Aldrich Chemical Co. (Milwaukee, Wis.) unless otherwise specified.

Preparation of Copolymers

The copolymers were made by suspension polymerization using a procedure described in the literature (W. S. Port et.al., *Industrial and Engineering Chemistry* 1955, 47, 472–480). Monomers were charged at 35% total solution. Polyvinyl alcohol (VINOL 350 TM from Air Products) at 1.5% total solution was used as a suspension stabilizer and benzoyl peroxide was used as an initiator at about 0.15% of monomer by weight. Polymerizations were conducted in a Parr shaker bomb at 50° C. for 48 hours. Actual monomer and initiator charges and weight of isolated, dried product are listed in Table 1 below. Products were collected by filtration, washed five times with cold water, twice with hot methanol, and dried in a vacuum oven at 30°–40° C. Product A was soluble in tetrahydrofuran and used without further purification. Products B, C, and D contained a tetrahydrofuran insoluble fraction which was removed by filtration through a glass wool plug and discarded. The soluble fraction was recovered by precipitation with methanol. Products were characterized by inherent viscosities measured in tetrahydrofuran, glass transition temperatures measured by differential scanning calorimetry, and percent chlorine by combustion analysis. Results are given in Table 1. Properties of a sample of vinyl chloride homopolymer from Borden (VC-106 PM) are listed for reference. A sample of vinyl stearate homopolymer obtained from Aldrich Chemical Company and used for comparison in dye transfer studies was found to have a melting point of 40° C., but no $T_g$ was detected above −100° C.

TABLE 1

| Sample | Monomer: Vinyl Chloride (g) | Monomer: Vinyl Stearate (g) | Initiator Wt % (g) | Dried Product | Inherent* Viscosity (I.V.) (dl/g) | Tg (°C.) | Wt % Chloride |
|---|---|---|---|---|---|---|---|
| VC-106 | Homopolymer Control | | | | 1.03 | 87 | 55.5 |
| A | 66.5 | 3.5 | 0.15 | 57.2 g | 1.14 | 75 | 55.9 |
| B | 63.0 | 7.0 | 0.14 | 52.7 | 1.06 | 76 | 52.5 |
| C | 56.0 | 14.0 | 0.13 | 42.3 | 1.03 | 66 | 51.4 |
| D | 38.0 | 24.5 | 0.13 | 17.4 | 0.67 | 39 | 40.8 |

*Solvent used in I.V. measurement was tetrahydrofuran.

EXAMPLE 1

A 15 wt % solution of a copolymer of vinyl chloride (90 wt %) and vinyl acetate (10 wt %) in methyl ethyl ketone was coated at a wet thickness of 0.08 mm onto an opaque polyester film (Melinex TM 994, available from ICI) and dried in an oven at a temperature of 75° C. for five minutes to form an image-receiving layer.

A dispersion of silver behenate half soap (1 mole of silver behenate to 1 mole of benehic acid, 10 wt % solids) in toluene (10 wt %) and ethyl alcohol (90 wt %) was made by a homogenization process. A portion of the 10 wt % half soap dispersion (110 g) was diluted with ethyl alcohol (380 g). Then poly(vinyl butyral) (0.4 g) was added to the dilute dispersion and dissolved.

Mercury bromide (10 ml of a solution containing 1.8 g $HgBr_2$ in 100 ml of methyl alcohol) was added to the dispersion with stirring. Additional poly(vinyl butyral) (29 g), having a poly(vinyl alcohol) content in the range of 9–13, was added to the dispersion. This dispersion is hereinafter referred to as Dispersion A.

Three drops of a fluorocarbon coating additive (FLUORAD FC431 TM from 3M Company) used as a stripping agent were added to 25 g of Dispersion A and the resulting dispersion mixed. The resulting mixed dispersion was coated over the image-receiving layer at a wet thickness of 0.08 mm and dried in an oven at a temperature of 75° C. for 5 minutes to form a strippable emulsion layer.

The following polymer solutions were coated over the emulsion layer at a wet thickness of 0.08 mm and dried in an oven at a temperature of 75° C. for 5 minutes to form a barrier interlayer:

| SAMPLE | DESCRIPTION |
|---|---|
| 1 | 3.5% solution of polyvinyl chloride (VC106 PM TM from Borden Chemical) in tetrahydrofuran. |
| 2 | 3.5% solution of polyvinyl bromide (from Polysciences, Inc.) in tetrahydrofuran. |
| 3 | 3.5% solution of polyvinyl acetate (AYAT from Untion Carbide) in tetrahydrofuran. |
| 4 | 3.5% solution of polyvinyl stearate (from Aldrich Chemical) in tetrahydrofuran (50%) and toluene (50%). |
| 5 | 3.5% solution of polyvinyl behenate (Polysciences, Inc.) in tetrahydrofuran (50%) and toluene (50%). |
| 6 | 3.5% solution of polyvinyl butyral (Butvar B-76 TM from Monsanto) in ethanol (50%) and methyl ethyl ketone (50%). |
| 7 | 3.5% solution of polyvinyl formal (Formvar 15/95 E TM from Monsanto) in dioxine (50%) and methyl ethyl ketone (50%). |
| 8 | 3.5% solution of polyvinyl benzyl chloride (from Aldrich Chemical) in tetrahydrofuran. |
| 9 | 3.5% solution of polyvinyl carbazole (from Aldrich Chemical) in tetrahydrofuran. |
| 10 | 3.5% solution of polyvinyl cinnamate (from Polysciences, Inc.) in tetrahydrofuran. |
| 11 | 3.5% solution of polymethyl methacrylate (Acryloid A-21 TM from Rohm and Haas) in methyl ethyl ketone (50%) and toluene (50%). |
| 12 | 3.5% solution of polystyrene (Styron 685D TM from Dow Chemical) in methyl ethyl ketone (50%) and toluene (50%). |
| 13 | 3.5% solution of cellulose acetate (CA398-6 TM from Kodak Chemical) in acetone (76%), 2-propanol (18%) and methanol (6%). |
| 14 | 3.5% solution of cellulose acetate butyrate (CAB 553-0.4 TM from Kodak Chemical) in acetone (76%), 2-propanol (18%) and methanol (6%). |

-continued

| SAMPLE | DESCRIPTION |
|---|---|
| 15 | 3.5% solution of cellulose acetate propionate (CAP 504-0.2 TM from Kodak Chemical) in acetone (76%), 2-propanol (18%) and methanol (6%). |
| 16 | 3.5% solution of polyvinyl pyrrolidone (PVP K90 TM from GAF Corp.) in methanol (50%), ethanol (40%) and 2-propanol (10%). |

Color emulsions which are described below were coated over the barrier interlayer.

Cyan Emulsion

Cyan leuco dye (0.3 g), 3,6-bis(diethylamino)-9-(4-methyl benzoyl)phenoxazine (from Hodogaya Chemical) which was pre-dissolved in 3 ml of toluene, a red sensitizing dye (1 ml of a solution containing 0.005 g of dye in 150 ml of toluene and 50 ml of methanol), and 0.1 g of 4-methylphthalic acid were added to 25 g of Dispersion A and the resulting dispersion mixed and coated over the barrier interlayer at a wet thickness of 0.13 mm and dried in an oven at a temperature of 75° C. for five minutes to form a cyan emulsion layer.

Magenta Emulsion

Magenta leuco dye (0.15 g), isobutyl ketazine, and 0.12 g of 1(2H)-phthalazinone which were pre-dissolved in 6 ml of ethanol and 2 ml of toluene, and a green sensitizing dye (1 ml of a solution containing 0.01 g of dye in 100 ml of methanol) were added to 25 g of Dispersion A and the resulting dispersion was mixed and coated over the barrier interlayer at a wet thickness of 0.13 mm and dried in an oven at a temperature of 75° C. for 5 minutes to form a magenta emulsion layer.

Yellow Emulsion

A dispersion of silver behenate half soap (1 mole of silver behenate to 1 mole of behenic acid, 10% solids) in toluene (10%) and ethyl alcohol (90%) was made by a homogenization process. A portion of the 10% half soap dispersion (205 g) was diluted with ethyl alcohol (285 g). Poly(vinyl butyral) (0.4 g) was then added to the dilute dispersion and dissolved.

Mercury bromide (6 ml of a solution containing 1.8 g $HgBr_2$ in 100 ml of methyl alcohol) was added to the dispersion with stirring and the resulting dispersion was mixed for three hours. Zinc bromide (8 ml of a solution containing 2.25 g $ZnBr_2$ in 100 ml of methyl alcohol) was then added to the dispersion with stirring and the resulting dispersion was mixed for an hour. Additional poly(vinyl butyral) (26 g) was added to the dispersion and dissolved. This dispersion will hereinafter be referred to as Dispersion B.

2-(3,5-Di-tert-butyl-4-hydroxyphenyl)-4-phenyl-5-(3-nitro-4-ethoxyphenyl)imidazole (0.3 g) leuco dye, 1(2H)-phthalazinone (0.25 g), and a blue sensitizing dye (1 ml of a solution containing 0.02 g of dye in 100 ml of methyl alcohol) were added to 25 g of Dispersion B and the resulting dispersion mixed. The resulting mixed dispersion was coated over the barrier interlayer at a wet thickness of 0.10 mm and dried in an oven at a temperature of 75° C. for five minutes to form a yellow emulsion layer.

The green sensitizing dye used in the examples is disclosed in U.S. Pat. No. 4,476,220 and has the following structural formula:

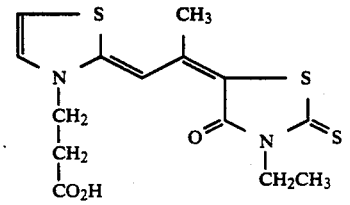

The blue sensitizing dye used in the examples is disclosed in U.S. Pat. No. 4,123,282 and has the following structural formula:

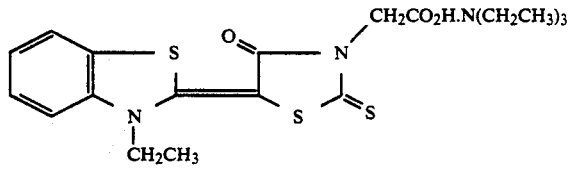

The red sensitizing dye used in the examples is disclosed in U.S. Pat. No. 3,719,495 and has the following structural formula:

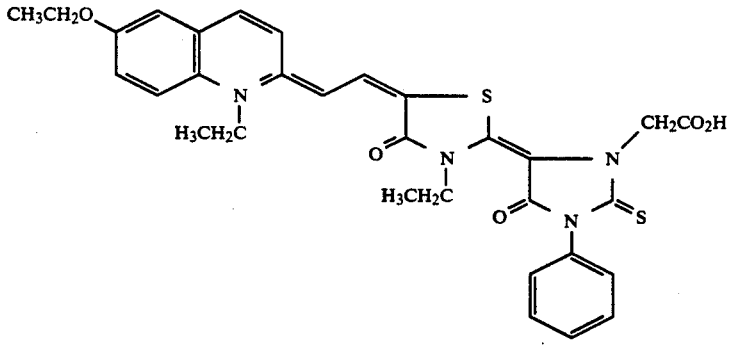

Sheets cut from the resulting articles were divided into two groups. One group was used to test the barrier properties of the polymers. The other was used to test for permeability of the polymers to each of the cyan, magenta, and yellow dyes.

The portion of the element containing the emulsion layers and the barrier interlayer that was not exposed to light and not heat-developed was stripped away from the image-receiving layer.

N-Bromosuccinimide solution (NBS) (0.8 g in 50 ml acetone and 50 ml toluene) was dropped (approximately 0.015 ml) on the image-receiving layer. In instances where the leuco dye had migrated to the image-receiving layer through the barrier interlayer during the coating and the drying operations, the migrated leuco was oxidized by the NBS and colored in the image-receiving layer. In instances where no color was observed in the image-receiving layer when the NBS was dropped on the image receiving layer, no leuco dye had migrated to the image-receiving layer and the polymer functions effectively as a barrier interlayer during the solvent coating and drying steps.

The results of the barrier property tests are given in Table 2.

TABLE 2

| SAMPLE | $T_g$ (°C.) | BARRIER (Yes or No) |
|---|---|---|
| 1 polyvinyl chloride | 87 | Yes |
| 2 polyvinyl bromide | 94 | No |
| 3 polyvinyl acetate | 45 | No |
| 4 polyvinyl stearate | <−100 | No |
| 5 polyvinyl behenate | <−100 | No |
| 6 polyvinyl butyral | 70 | No |
| 7 polyvinyl formal | 108 | Yes |
| 8 polyvinylbenzylchloride | 64 | Yes |
| 9 polyvinylcarbazole | 200 | Yes |
| 10 polyvinyl cinnamate | 78 | Yes |
| 11 polymethyl methacrylate | 105 | Yes |
| 12 polystyrene | 100 | Yes |
| 13 cellulose acetate | 182 | Yes |
| 14 cellulose acetate butyrate | 101 | No |
| 15 cellulose acetate propionate | 147 | No |
| 16 polyvinyl pyrrolidone | 179 | No |

These results demonstrate that impermeability to the solvent(s) to be used in the emulsion is essential for the barrier property.

The other group of the sheets cut from the resulting photothermographic articles, respectively, were exposed to an EG&G sensitometer through a Wratten 25, Wratten 58, or Wratten 47B filter for $10^{-3}$ second to produce heat-developable latent images in the emulsion layers and the images were then heat-developed at a temperature of 138° C. on a heat blanket for 35 seconds. The portion of the element containing the photothermographic emulsion layers and the interlayer was then stripped away from the image-receiving layer. Dye images in the image-receiving layer corresponding to the light exposed areas of the sheets were measured by the densitometer. The results of the sensitometric data obtained from each sample are given in Table 3.

TABLE 3

| Sample | Cyan | Magenta | Yellow |
|---|---|---|---|
| 1 Polyvinyl chloride | | | |
| $D_{min}$ | 0.14 | 0.09 | 0.08 |
| $D_{max}$ | 2.11 | 1.76 | 1.29 |
| Ergs/cm$^2$ at 0.6 D + $D_{min}$ | 151 | 148 | 42 |
| 2 Polyvinyl bromide | | | |
| $D_{min}$ | 0.15 | 0.11 | 0.11 |
| $D_{max}$ | 0.89 | 2.81 | 0.94 |
| Ergs/cm$^2$ at 0.6 D + $D_{min}$ | 2,455 | 245 | 83 |
| 3 Polyvinyl acetate | | | |
| $D_{min}$ | 0.16 | 0.10 | 0.11 |
| $D_{max}$ | 1.76 | 2.92 | 2.59 |
| Ergs/cm$^2$ at 0.6 D + $D_{min}$ | 692 | 120 | 56 |
| 4 Polyvinyl stearate | | | |
| $D_{min}$ | 0.14 | 0.12 | 0.13 |
| $D_{max}$ | 2.23 | 3.29 | 2.48 |

TABLE 3-continued

| Sample | Cyan | Magenta | Yellow |
|---|---|---|---|
| Ergs/cm$^2$ at 0.6 D + $D_{min}$ | 172 | 95 | 32 |
| 5 Polyvinyl behenate | | | |
| $D_{min}$ | 0.21 | 0.12 | 0.19 |
| $D_{max}$ | 1.40 | 3.23 | 2.54 |
| Ergs/cm$^2$ at 0.6 D + $D_{min}$ | 1,622 | 52 | 10 |
| 6 Polyvinyl butyral | | | |
| $D_{min}$ | 0.13 | 0.12 | 0.09 |
| $D_{max}$ | 1.21 | 3.39 | 2.09 |
| Ergs/cm$^2$ at 0.6 D + $D_{min}$ | 776 | 91 | 78 |
| 7 Polyvinyl formal | | | |
| $D_{min}$ | 0.10 | 0.11 | 0.06 |
| $D_{max}$ | 0.44 | 0.39 | 0.27 |
| Ergs/cm$^2$ at 0.6 D + $D_{min}$ | — | — | — |
| 8 Polyvinyl benzyl chloride | | | |
| $D_{min}$ | 0.12 | 0.09 | 0.11 |
| $D_{max}$ | 0.95 | 1.20 | 1.43 |
| Ergs/cm$^2$ at 0.6 D + $D_{min}$ | 813 | 234 | 24 |
| 9 Polyvinyl carbazole | | | |
| $D_{min}$ | 0.09 | 0.09 | 0.04 |
| $D_{max}$ | 0.09 | 0.09 | 0.05 |
| Ergs/cm$^2$ at 0.6 D + $D_{min}$ | — | — | — |
| 10 Polyvinyl cinnamate | | | |
| $D_{min}$ | 0.14 | 0.10 | 0.11 |
| $D_{max}$ | 1.07 | 1.30 | 1.29 |
| Ergs/cm$^2$ at 0.6 D + $D_{min}$ | 479 | 347 | 81 |
| 11 Polymethyl methacrylate | | | |
| $D_{min}$ | 0.11 | 0.10 | 0.06 |
| $D_{max}$ | 0.25 | 0.23 | 0.40 |
| Ergs/cm$^2$ at 0.6 D + $D_{min}$ | — | — | — |
| 12 Polystyrene | | | |
| $D_{min}$ | 0.09 | 0.10 | 0.08 |
| $D_{max}$ | 0.16 | 0.56 | 0.97 |
| Ergs/cm$^2$ at 0.6 D + $D_{min}$ | — | — | 59 |
| 13 Cellulose acetate | | | |
| $D_{min}$ | 0.09 | 0.09 | 0.04 |
| $D_{max}$ | 0.43 | 0.13 | 0.06 |
| Ergs/cm$^2$ at 0.6 D + $D_{min}$ | — | — | — |
| 14 Cellulose acetate butyrate | | | |
| $D_{min}$ | 0.12 | 0.11 | 0.11 |
| $D_{max}$ | 1.04 | 2.91 | 2.18 |
| Ergs/cm$^2$ at 0.6 D + $D_{min}$ | 977 | 132 | 76 |
| 15 Cellulose acetate propionate | | | |
| $D_{min}$ | 0.11 | 0.10 | 0.09 |
| $D_{max}$ | 0.16 | 2.51 | 2.22 |
| Ergs/cm$^2$ at 0.6 D + $D_{min}$ | | — | 158110 |
| 16 Polyvinyl pyrrolidone | | | |
| $D_{min}$ | 0.10 | 0.11 | 0.07 |
| $D_{max}$ | 0.15 | 3.27 | 1.24 |
| Ergs/cm$^2$ at 0.6 D + $D_{min}$ | — | 110 | 229 |

As used herein, "$D_{min}$" means the minimum optical image density in exposed regions; and "$D_{max}$" means the maximum optical image density in exposed regions.

Thermoplastic polymers may be more or less permeable to dyes when heated to elevated temperatures. They are more permeable to dyes if the glass transition temperatures are lower than the heat-development temperature.

Polyvinyl acetate, polyvinyl behenate, polyvinyl butyral, polyvinyl chloride, polyvinyl pyrrolidone, polyvinyl stearate, cellulose acetate butyrate, and cellulose acetate propionate showed good permeability to the dyes in this test. Of those polymers, only polyvinyl chloride also showed good solvent barrier properties.

EXAMPLE 2

The image-receiving layer and the strippable emulsion layer were prepared in the same manner as described in Example 1.

The following polymer solutions were coated over the strippable emulsion layer at a wet thickness of 0.08 mm and dried in an oven at a temperature of 75° C. for 5 minutes to form a barrier interlayer:

| SAMPLE | DESCRIPTION |
|---|---|
| 1 | 3.5% solution of vinyl chloride homoplymer in tetrahydrofuran. |
| 2 | 3.5% solution of blend of polyvinyl chloride (95 wt. %) and polyvinyl stearate (5 wt. %) in tetrahydrofuran. |
| 3 | 3.5% solution of blend of polyvinyl chloride (90 wt. %) and polyvinyl stearate (10 wt. %) in tetrahydrofuran. |
| 4 | 3.5% solution of blend of polyvinyl chloride (80 wt. %) and polyvinyl stearate (20 wt. %) in tetrahydrofuran. |

The color emulsion layers of cyan, magenta, and yellow were respectively prepared on the barrier interlayers in the same manner as described in Example 1. Sheets cut from the resulting articles were tested in the same manner as described in Example 1 in regard to the barrier property to the color emulsion solutions and the permeability to the dyes. The results were given in Table 4 (the barrier property) and Table 5 (the permeability to the dyes).

TABLE 4

| Sample | $T_g$ (°C.) | Effective Barrier (Yes or No) |
|---|---|---|
| 1 Vinyl chloride homopolymer | 87 | Yes |
| 2 Blend of polyvinyl chloride (95%) and polyvinyl stearate (5%) | 74 | Yes |
| 3 Blend of polyvinyl chloride (90%) and polyvinyl stearate (10%) | 74 | Yes |
| 4 Blend of polyvinyl chloride (80%) and polyvinyl stearate (20%) | 74 | Yes |

TABLE 5

| Sample | Cyan | Magenta | Yellow |
|---|---|---|---|
| 1 Vinyl chloride homopolymer | | | |
| $D_{min}$ | 0.14 | 0.09 | 0.09 |
| $D_{max}$ | 2.12 | 1.57 | 1.01 |
| Ergs/cm$^2$ at 0.6 D + $D_{min}$ | 151 | 129 | 45 |
| 2 Blend of polyvinyl chloride (95%) and polyvinyl stearate (5%) | | | |
| $D_{min}$ | 0.16 | 0.09 | 0.13 |
| $D_{max}$ | 2.41 | 1.95 | 1.47 |
| Ergs/cm$^2$ at 0.6 D + $D_{min}$ | 138 | 100 | 30 |
| 3 Blend of polyvinyl chloride (90%) and polyvinyl stearate (10%) | | | |
| $D_{min}$ | 0.15 | 0.09 | 0.13 |
| $D_{max}$ | 2.32 | 2.10 | 1.62 |
| Ergs/cm$^2$ at 0.6 D + $D_{min}$ | 141 | 102 | 24 |
| 4 Blend of polyvinyl chloride (80%) and polyvinyl stearate (20%) | | | |
| $D_{min}$ | 0.17 | 0.09 | 0.13 |
| $D_{max}$ | 2.52 | 2.28 | 1.82 |
| Ergs/cm$^2$ at 0.6 D + $D_{min}$ | 129 | 91 | 24 |

These results demonstrate that improved dye receptivity is achieved by blending polyvinyl chloride with polyvinyl stearate, even at low amounts of polyvinyl stearate.

EXAMPLE 3

The image-receiving layer and the strippable emulsion layer were prepared in the same manner as described in Example 1. The following polymer solutions were coated over the strippable emulsion layer at a wet thickness of 0.08 mm and dried in an oven at a temperature of 75° C. for 5 minutes to form a barrier interlayer.

| SAMPLE | DESCRIPTION |
|---|---|
| 1 | 3.5% solution of vinyl chloride homoplymer in tetrahydrofuran. |
| 2 | 3.5% solution of copolymer of vinyl chloride (95%) and vinyl stearate (5%) in tetrahydrofuran. |
| 3 | 3.5% solution of copolymer of vinyl chloride (90%) and vinyl stearate (10%) in tetrahydrofuran. |
| 4 | 3.5% solution of copolymer of vinyl chloride (80%) and vinyl stearate (20%) in tetrahydrofuran. |
| 5 | 3.5% solution of copolymer of vinyl chloride (65%) and vinyl stearate (35%) in tetrahydrofuran. |
| 6 | 3.5% solution of vinyl stearate homopolymer in tetrahydrofuran. |

The color emulsion layers of cyan, magenta, and yellow were respectively prepared on the barrier interlayers in the same manner as described in Example 1. Sheets cut from the resulting articles were tested in the same manner as described in Example 1 in regard to the barrier property to the color emulsion solutions and the permeability to the dyes. The results were given in Table 6 (the barrier property) and Table 7 (the permeability to the dyes).

TABLE 6

| Sample | $T_g$ (°C.) | Effective Barrier (Yes or No) |
|---|---|---|
| 1 Vinyl chloride homopolymer | 87 | Yes |
| 2 Blend of polyvinyl chloride (95%) and polyvinyl stearate (5%) | 75 | Yes |
| 3 Copolymer of vinyl chloride (90%) and vinyl stearate (10%) | 76 | Yes |
| 4 Copolymer of vinyl chloride (80%) and vinyl stearate (20%) | 66 | Yes |
| 5 Copolymer of vinyl chloride (69%) and vinyl stearate (31%) | 39 | No |
| 6 Vinyl stearate homopolymer | $<-100$ | No |

TABLE 7

| Sample | Cyan | Magenta | Yellow |
|---|---|---|---|
| 1 Vinyl chloride homopolymer | | | |
| $D_{min}$ | 0.15 | 0.09 | 0.09 |
| $D_{max}$ | 2.25 | 1.79 | 0.95 |
| Ergs/cm$^2$ at 0.6 D + $D_{min}$ | 107 | 145 | 59 |
| 2 Copolymer of polyvinyl chloride (95%) and polyvinyl stearate (5%) | | | |
| $D_{min}$ | 0.16 | 0.09 | 0.11 |
| $D_{max}$ | 2.39 | 2.14 | 1.61 |
| Ergs/cm$^2$ at 0.6 D + $D_{min}$ | 112 | 151 | 41 |
| 3 Copolymer of polyvinyl chloride (90%) and polyvinyl stearate (10%) | | | |
| $D_{min}$ | 0.16 | 0.09 | 0.10 |
| $D_{max}$ | 2.44 | 2.18 | 1.94 |
| Ergs/cm$^2$ at 0.6 D + $D_{min}$ | 115 | 145 | 43 |
| 4 Copolymer of polyvinyl chloride (80%) and polyvinyl stearate (20%) | | | |
| $D_{min}$ | 0.16 | 0.09 | 0.12 |
| $D_{max}$ | 2.46 | 2.41 | 2.21 |
| Ergs/cm$^2$ at 0.6 D + $D_{min}$ | 117 | 158 | 24 |
| 5 Copolymer of polyvinyl chloride (61%) and polyvinyl stearate (39%) | | | |
| $D_{min}$ | 0.18 | 0.09 | 0.13 |
| $D_{max}$ | 2.44 | 3.43 | 2.45 |
| Ergs/cm$^2$ at 0.6 D + $D_{min}$ | 145 | 105 | 46 |
| 6 Polyvinyl stearate | | | |
| $D_{min}$ | 0.22 | 0.12 | 0.14 |
| $D_{max}$ | 2.45 | 3.20 | 2.64 |

TABLE 7-continued

| Sample | Cyan | Magenta | Yellow |
|---|---|---|---|
| Ergs/cm$^2$ at 0.6 D + $D_{min}$ | 132 | 68 | 26 |

Tables 6 and 7 demonstrate that copolymers of vinyl chloride and vinyl stearate are effective as dye permeable interlayers in much the same manner as blends of polyvinyl chloride and polyvinyl stearate.

EXAMPLE 4

The image-receiving layer and the strippable emulsion layer were prepared in the same manner as described in Example 1.

The following polymer solutions were coated over the strippable emulsion layer at a wet thickness of 0.08 mm and dried in an oven at a temperature of 75° C. for 5 minutes to form a barrier interlayer.

| SAMPLE | DESCRIPTION |
|---|---|
| 1 | 3.5% solution of vinyl chloride homoplymer in tetrahydrofuran. |
| 2 | 3.5% solution of blend of polyvinyl chloride (95%) and polyvinyl acetate (10%) in tetrahydrofuran. |
| 3 | 3.5% solution of blend of polyvinyl chloride (90%) and polyvinyl stearate (10%) in tetrahydrofuran. |
| 4 | 3.5% solution of copolymer of vinyl chloride (90%) and vinyl acetate (10%) (UCAR VYNS-3 from Union Carbide) in tetrahydrofuran. |
| 5 | 3.5% solution of copolymer of vinyl chloride (90%) and vinyl stearate (10%) in tetrahydrofuran. |
| 6 | 3.5% solution of terpolymer of vinyl chloride (81%), vinyl acetate (4%) and hydroxylalkyl acrylate (15%) (UCAR VROH TM from Union Carbide) in 1-methoxy-2-propanol. |

The color emulsion layer of cyan, magenta, and yellow were respectively prepared on the barrier interlayers in the same manner as described in Example 1. Sheets cut from the resulting articles were tested in the same manner as described in Example 1 in regard to the barrier property to the color emulsion solutions and the permeability to the dyes. The results were given in Table 8 (the barrier property) and Table 9 (the permeability to the dyes).

TABLE 8

| Sample | $T_g$ (°C.) | Effective Barrier (Yes or No) |
|---|---|---|
| 1 Vinyl chloride homopolymer | 87 | Yes |
| 2 Blend of polyvinyl chloride (90%) and polyvinyl acetate (10%) | 62 | Yes |
| 3 Blend of polyvinyl chloride (90%) and polyvinyl stearate (10%) | 74 | Yes |
| 4 Copolymer of vinyl chloride (90%) and vinyl acetate (10%) | 79 | Yes |
| 5 Copolymer of vinyl chloride (90%) and vinyl stearate (10%) | 75 | Yes |
| 6 Terpolymer of vinyl chloride (81%), vinyl acetate (4%), and hydroxyalkylacrylate (15%) | 65 | Yes |

TABLE 9

| Sample | Cyan | Magenta | Yellow |
|---|---|---|---|
| 1 Vinyl chloride homopolymer | | | |
| $D_{min}$ | 0.12 | 0.09 | 0.09 |
| $D_{max}$ | 2.03 | 1.65 | 1.00 |
| Ergs/cm$^2$ at 0.6 D + $D_{min}$ | 100 | 130 | 55 |

TABLE 9-continued

| Sample | Cyan | Magenta | Yellow |
|---|---|---|---|
| 2 Blend of polyvinyl chloride (90%) and polyvinyl acetate (10%) | | | |
| $D_{min}$ | 0.13 | 0.09 | 0.10 |
| $D_{max}$ | 2.16 | 2.09 | 1.31 |
| Ergs/cm$^2$ at 0.6 D + $D_{min}$ | 98 | 102 | 55 |
| 3 Blend of polyvinyl chloride (90%) and polyvinyl stearate (10%) | | | |
| $D_{min}$ | 0.15 | 0.09 | 0.13 |
| $D_{max}$ | 2.32 | 2.10 | 1.62 |
| Ergs/cm$^2$ at 0.6 D + $D_{min}$ | 92 | 100 | 35 |
| 4 Copolymer of vinyl chloride (90%) and vinyl acetate (10%) | | | |
| $D_{min}$ | 0.13 | 0.09 | 0.09 |
| $D_{max}$ | 2.16 | 2.12 | 1.52 |
| Ergs/cm$^2$ at 0.6 D + $D_{min}$ | 96 | 169 | 50 |
| 5 Copolymer of vinyl chloride (90%) and vinyl stearate (10%) | | | |
| $D_{min}$ | 0.16 | 0.09 | 0.12 |
| $D_{max}$ | 2.46 | 2.41 | 2.21 |
| Ergs/cm$^2$ at 0.6 D + $D_{min}$ | 120 | 162 | 43 |
| 6 Terpolymer of vinyl chloride (81%), vinyl acetate (4%), and hydroxyalkylacrylate (15%) | | | |
| $D_{min}$ | 0.15 | 0.11 | 0.12 |
| $D_{max}$ | 1.68 | 2.69 | 1.85 |
| Ergs/cm$^2$ at 0.6 D + $D_{min}$ | 186 | 195 | 59 |

Tables 8 and 9 show that vinyl stearate blends and copolymers show consistently better dye receptivity than other barrier polymers and blends.

EXAMPLE 5

The image-receiving layer was prepared on an opaque polyester film in the same manner as described in Example 1.

0.10 g of isobutyl syringketazine and 0.05 g of 1(2H)-phthalazinone which were pre-dissolved in 3 cc of ethylalcohol and 2 cc of toluene, green sensitizing dye (1 cc of a solution containing 0.01 g of dye in 100 cc of methyl alcohol) and three drops of a fluorocarbon coating additive were added to 25 g of Dispersion A described in Example 1 and the resulting dispersion was mixed.

The resulting mixed dispersion was coated over the image-receiving layer at a wet thickness of 0.08 mm and dried in an oven at a temperature of 75° C. for five minutes to form a magenta emulsion layer.

The following polymer solutions were prepared as the barrier interlayer:

| SAMPLE | DESCRIPTION |
|---|---|
| 1 | 3.5% solution of vinyl chloride homoplymer in tetrahydrofuran. |
| 2 | 3.5% solution of blend of polyvinyl chloride (95%) and polyvinyl stearate (5%) in tetrahydrofuran. |
| 3 | 3.5% solution of copolymer of vinyl chloride (95%) and vinyl stearate (5%) in THF |

To 25 g of each polymer solution, 0.1 g of 1(2H)-phthalazinone was added and mixed.

The resulting solution was coated over the magenta emulsion layer at a wet thickness of 0.08 mm and dried in an oven at a temperature of 75° C. for five minutes to form a barrier interlayer.

A yellow emulsion layer was prepared over the barrier interlayer in the same manner as described in Example 1.

Sheets cut from the resulting photothermographic articles, respectively, were exposed to an EG&G sensitometer through a Wratten 58 or a Wratten 47B filter for $10^{-1}$ second to produce heat-developable latent images in the emulsion layers and the images were heat-developed at a temperature of 138° C. on a heat-blanket for 30 seconds.

The portion of the element containing the photothermographic emulsion layers and the barrier interlayer was then stripped away from the image-receiving layer.

Clear magenta or yellow dye image was observed to have been diffusion-transferred to the image-receiving layer through the emulsion layers and the barrier interlayer corresponding to the green light or the blue light exposed area of the sheet.

The reflection densities of the dye images were measured by a densitometer with the complimentary filter to the dye. The results of the sensitometric data obtained from each sample are given in Table 10.

TABLE 10

| Density in Image-Receiving Layer | Sample 1 | Sample 2 | Sample 3 |
|---|---|---|---|
| Magenta (Green Light Exposed Area) | | | |
| $D_{min}$ | 0.10 | 0.11 | 0.11 |
| $D_{max}$ | 2.20 | 2.52 | 2.55 |
| Ergs/cm$^2$ at 0.6 D + $D_{min}$ | 130 | 101 | 98 |
| Yellow (Blue Light Exposed Area) | | | |
| $D_{min}$ | 0.11 | 0.13 | 0.13 |
| $D_{max}$ | 1.25 | 1.65 | 1.70 |
| Ergs/cm$^2$ at 0.6 D + $D_{min}$ | 70 | 30 | 25 |

As shown by the above results, the yellow dye density in the image-receiving layer could be significantly increased (about 30 to 35% higher than the control) when the polymers used in this invention were used as the barrier interlayer in a multilayer construction.

EXAMPLE 6

The following polymer solutions were coated at a wet thickness of 0.13 mm onto an opaque polyester film to form an image-receiving layer and dried at 75° C. for 5 minutes in an oven:

Sample 1: 5% vinylchloride homopolymer in tetrahydrofuran/methoxypropanol (70/30)

Sample 2: 5% copolymer of vinylchloride/vinylacetate (VYNS made by Union Carbide) in tetrahydrofuran/methoxypropanol (70/30)

Sample 3: 5% copolymer of vinylchloride/vinylstearate in tetrahydrofuran/methoxypropanol (70/30).

The magenta emulsion described in Example 1 was coated over the image-receiving layer at a wet thickness of 0.13 mm and dried in an oven at a temperature of 75° C. for 5 minutes to form a magenta emulsion layer.

A topcoat solution consisting of 6 g of cellulose acetate (CA-3980b from Eastman Chemical), 1.58 g of polymethylmethacrylate (Acryloid A-21 from Rohm and Haas), .42 g of 1(2H)-phthalazinone in 70 g of acetone, and 22 g of isopropylalcohol was coated over the magenta emulsion layer at a wet thickness of 0.08 mm and dried at 75° C. for 5 minutes in an oven.

The resulting sheets were exposed to EG&G sensitometer through Wratten 58 for $10^{-3}$ seconds and heat processed at 138° C. for 20 seconds. The coating layers were stripped off from the image-receiving layer.

Clear magenta dye image was observed to have been transferred to the image-receiving layer corresponding to the green light exposed area of the material.

The following sensitometric data was obtained from the samples:

| Image-Receiving Layer | Sample 1 | Sample 2 | Sample 3 |
|---|---|---|---|
| $D_{min}$ | 0.11 | 0.10 | 0.11 |
| $D_{max}$ | 2.14 | 2.24 | 2.26 |
| Ergs/cm$^2$ at 0.6 D + $D_{min}$ | 28 | 15 | 13 |

Sample 3 showed the highest density and speed.

Reasonable modifications and variations are possible from the foregoing disclosure without departing from either the spirit or scope of the invention as defined in the claims.

What is claimed is:

1. An imageable article comprising: (a) an image-forming layer comprising a light-insensitive, reducible silver source; a light-sensitive silver halide; a polymeric binder; a sensitizer; and a material capable of forming a mobile dye upon oxidation; and (b) an image-receiving layer, wherein a polymeric interlayer is interposed between said image-forming layer and said image-receiving layer and wherein said polymeric interlayer comprises a copolymer of vinyl chloride and vinyl stearate or a blend of polyvinyl chloride and polyvinyl stearate, said copolymer or blend having a $T_g$ of at least about 45° C.

2. The imageable article according to claim 1 wherein said light-insensitive, reducible silver source comprises a silver salt of an aliphatic carboxylic acid.

3. The imageable article according to claim 2 wherein said light-insensitive, reducible silver source comprises silver behenate.

4. The imageable article according to claim 1 wherein said light-sensitive silver halide comprises silver bromide.

5. The imageable article according to claim 1 wherein said material capable of forming a mobile dye upon oxidation is a leuco dye.

6. The imageable article according to claim 1 wherein said image-forming layer further comprises toning agent.

7. The imageable article according to claim 1 wherein the weight ratio of vinyl stearate to vinyl chloride in said interlayer is from about 3.5 to 19:1.

8. The imageable article according to claim 7 wherein the weight ratio of vinyl stearate to vinyl chloride in said interlayer is from 4 to 19:1.

9. The imageable article according to claim 1 wherein said copolymer or blend has a $T_g$ of at least about 60° C.

10. A dry silver photothermographic element comprising a substrate coated on one side thereof with an image-receiving layer, said image-receiving layer having coated thereon at least one image-forming layer comprising a a light-insensitive, reducible silver source; a light-sensitive silver halide; a polymeric binder; a sensitizer; and a material capable of forming a mobile dye upon oxidation, separated from said image-receiving layer by a polymeric interlayer, said polymeric interlayer comprising a copolymer of vinyl chloride and vinyl stearate or a blend of polyvinyl chloride and polyvinyl stearate, said blend or copolymer having a $T_g$ of at least about 45° C.

11. The dry silver photothermographic element according to claim 10 wherein light-insensitive, reducible silver source comprises a silver salt of an aliphatic carboxylic acid.

12. The dry silver photothermographic element according to claim 11 wherein said light-insensitive, reducible silver source comprises silver behenate.

13. The dry silver photothermographic element according to claim 10 wherein said light-sensitive silver halide comprises silver bromide.

14. The dry silver photothermographic element according to claim 10 wherein said material capable of forming a mobile dye upon oxidation is a leuco dye.

15. The dry silver photothermographic element according to claim 10 wherein said image-forming layer further comprises toning agent.

16. The dry silver photographic element according to claim 10 wherein the weight ratio of vinyl stearate to vinyl chloride in said interlayer is from about 3.5 to 19:1.

17. The dry silver photothermographic element according to claim 16 wherein the weigh ratio of vinyl stearate to vinyl chloride in said interlayer is from 4 to 19:1.

18. The dry silver photothermographic element according to claim 10 wherein said blend or copolymer has a $T_g$ of at least about 60° C.

19. A dye-diffusive dry silver photothermographic element comprising a substrate on one side thereof coated with an image-receiving layer, said image-receiving layer having coated thereon at least one image-forming layer comprising a light-insensitive, reducible silver source; a light-sensitive silver halide; a polymeric binder; a sensitizer; and a material capable of forming a mobile dye upon oxidation wherein said image-receiving layer comprises a copolymer of vinyl chloride and vinyl or a blend of polyvinyl chloride and polyvinyl stearate, said copolymer or blend having a $T_g$ of at least about 45° C.

20. The photothermographic element according to claim 19 wherein said light-insensitive, reducible silver source comprises a silver salt of an aliphatic carboxylic acid.

21. The photothermographic element according to claim 20 wherein said light-insensitive, reducible silver source comprises silver behenate.

22. The photothermographic element according to claim 20 wherein said light-sensitive silver halide comprises silver bromide.

23. The photothermographic element according to claim 19 wherein said material capable of forming a mobile dye upon oxidation is a leuco dye.

24. The photothermographic element according to claim 19 wherein said image-forming layer further comprises toning agent.

25. The photothermographic element according to claim 19, wherein the weight ratio of vinyl stearate to vinyl chloride in said interlayer is from about 3.5 to 19:1.

26. The photothermographic element according to claim 25 wherein the weight ratio of vinyl stearate to vinyl chloride in said interlayer is from 4 to 19:1.

27. The photothermographic element according to claim 19 wherein said copolymer or blend has a $T_g$ of at least about 60° C.

* * * * *